US007787241B2

(12) United States Patent
Kim et al.

(10) Patent No.: US 7,787,241 B2
(45) Date of Patent: Aug. 31, 2010

(54) APPARATUS FOR COUPLING DISPLAY WINDOW AND BUTTONS FOR CLOTHING HANDLER

(75) Inventors: Hyo-Jin Kim, Gyeongsangnam-Do (KR); Ho-Sung Jang, Gyeongsangnam-Do (KR); Jae-Cheol Lyu, Gyeongsangnam-Do (KR); Han-Ki Cho, Gyeongsangnam-Do (KR); Chang-Woo Son, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/105,488

(22) Filed: Apr. 18, 2008

(65) Prior Publication Data

US 2008/0259548 A1 Oct. 23, 2008

(30) Foreign Application Priority Data

Apr. 20, 2007 (KR) ..... 10-2007-0039033

(51) Int. Cl.
*H05K 5/00* (2006.01)
*H05K 7/00* (2006.01)

(52) U.S. Cl. ..... 361/679.21

(58) Field of Classification Search ..... 361/681, 361/682, 683, 684, 685, 686; 68/3 R, 13 R; 34/527; 312/228
See application file for complete search history.

(56) References Cited

U.S. PATENT DOCUMENTS

| | | | | |
|---|---|---|---|---|
| 3,791,554 | A * | 2/1974 | Nagatani et al. | 221/289 |
| 4,336,886 | A * | 6/1982 | Azoulay et al. | 211/85.3 |
| 6,330,856 | B1 * | 12/2001 | Fitzgerald et al. | 100/52 |
| 7,217,026 | B2 * | 5/2007 | Nishikai et al. | 362/611 |
| 2006/0207121 | A1 * | 9/2006 | Lee | 34/89 |
| 2006/0265282 | A1 * | 11/2006 | Henley et al. | 705/14 |
| 2007/0113594 | A1 * | 5/2007 | Ahn et al. | 68/3 R |
| 2007/0169520 | A1 * | 7/2007 | Heo | 68/3 R |
| 2008/0043416 | A1 * | 2/2008 | Narayan | 361/683 |
| 2008/0112119 | A1 * | 5/2008 | Wang et al. | 361/681 |
| 2008/0258902 | A1 * | 10/2008 | Engellenner | 340/505 |
| 2009/0133448 | A1 * | 5/2009 | Yoon et al. | 68/13 R |
| 2009/0153004 | A1 * | 6/2009 | Han et al. | 312/228 |

FOREIGN PATENT DOCUMENTS

| | | |
|---|---|---|
| CN | 1783351 | 6/2006 |
| KR | 10-2002-0042169 | 6/2002 |
| KR | 10-2002-0042237 | 6/2002 |
| KR | 10-2002-0042239 | 6/2002 |
| KR | 10-2004-0011966 | 2/2004 |

OTHER PUBLICATIONS

Korea Office Action dated May 13, 2009.
Chinese Office Action dated Jan. 15, 2010 with translation.

* cited by examiner

*Primary Examiner*—Chandrika Prasad
(74) *Attorney, Agent, or Firm*—Ked & Associates LLP

(57) ABSTRACT

Disclosed is an apparatus for coupling a display window and buttons for a clothing handler. The apparatus for coupling the display window and the buttons for the clothing handler includes a display window configured to display each kind of information regarding handling clothing, buttons disposed to be adjacent to the display window, for selecting options for handling clothing, and a supporting member interposed between the display window and the buttons, for supporting at least one of the display window and the buttons.

32 Claims, 5 Drawing Sheets

APPARATUS FOR COUPLING DISPLAY WINDOW AND BUTTONS FOR CLOTHING HANDLER

BACKGROUND OF THE INVENTION

1. Field of the Invention

The present invention relates to a clothing handler, and more particularly, to an apparatus for coupling a display window and buttons for a clothing handler.

2. Description of the Related Art

Clothing handlers serve to perform each kind of process for clothing and include washing machines, dryers and so on.

The clothing handler is provided with a display window configured to display options for handling clothing and buttons configured to select the options for handling clothing. Generally, the display window and the buttons are collectively installed on a control panel. When collectively installing the display window and the buttons, the display window and the buttons should be adjacent to each other, for effective space utilization and a compact configuration for the clothing handler.

However, in the related clothing handler, the display window and the buttons are respectively coupled to the control panel. Due to this configuration, there is a limitation in disposing the display window and the buttons to be adjacent to each other. And, when excessively adjacent to each other, the display window and the buttons may be damaged.

SUMMARY OF THE INVENTION

Therefore, the present invention is directed to providing an apparatus for coupling a display window and buttons for a clothing handler having a structure for disposing a display window and buttons to be adjacent to each other and firmly supporting the display window and the buttons.

To achieve these and other advantages and in accordance with the purpose of the present invention, as embodied and broadly described herein, there is provided an apparatus for coupling a display window and buttons for a clothing handler, in the clothing handler for handling clothing received therein, comprising: a display window configured to display each kind of information regarding handling clothing, buttons disposed to be adjacent to the display window, for selecting options for handling clothing, and a supporting member interposed between the display window and the buttons, for supporting at least one of the display window and the buttons.

In accordance with another aspect of the present invention, there is provided an apparatus for coupling a display window and buttons for a clothing handler, in the clothing handler for handling clothing received therein, comprising: a display window configured to display each kind of information regarding handling clothing, buttons disposed to be adjacent to the display window, for selecting options for handling clothing, and a supporting member having a lower supporting portion extended between the display window and the buttons so as to support the display window.

In accordance with still another aspect of the present invention, there is provided an apparatus for coupling a display window and buttons for a clothing handler, in the clothing handler for handling clothing received therein, comprising: a display window configured to display each kind of information regarding handling clothing, buttons disposed to be adjacent to the display window, for selecting options for handling clothing, and a supporting member having a rear supporting portion extended toward a rear surface of the display window so as to support the display window.

In the apparatus for coupling the display window and the buttons for the clothing handler in accordance with one aspect of the present invention, the display window and the buttons are disposed to be adjacent to each other, and the supporting member is interposed therebetween. Accordingly, it is capable of implementing effective space utilization and a compact configuration for the product and having a more enhanced supporting structure.

Further, in the apparatus for coupling the display window and the buttons for the clothing handler, concavo-convex portions that can be engaged with each other are respectively formed at the display window and the supporting member. Accordingly, it is capable of coupling the display window to the supporting member more firmly. Therefore, the display window may be supported by the supporting member more firmly.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate preferred embodiments of the invention and together with the description serve to explain the principles of the invention.

In the drawings.

DETAILED DESCRIPTION OF THE INVENTION

Hereafter, description will now be given in detail of the preferred embodiments of the present invention, examples of which are illustrated in the accompanying drawings.

Figure 1:
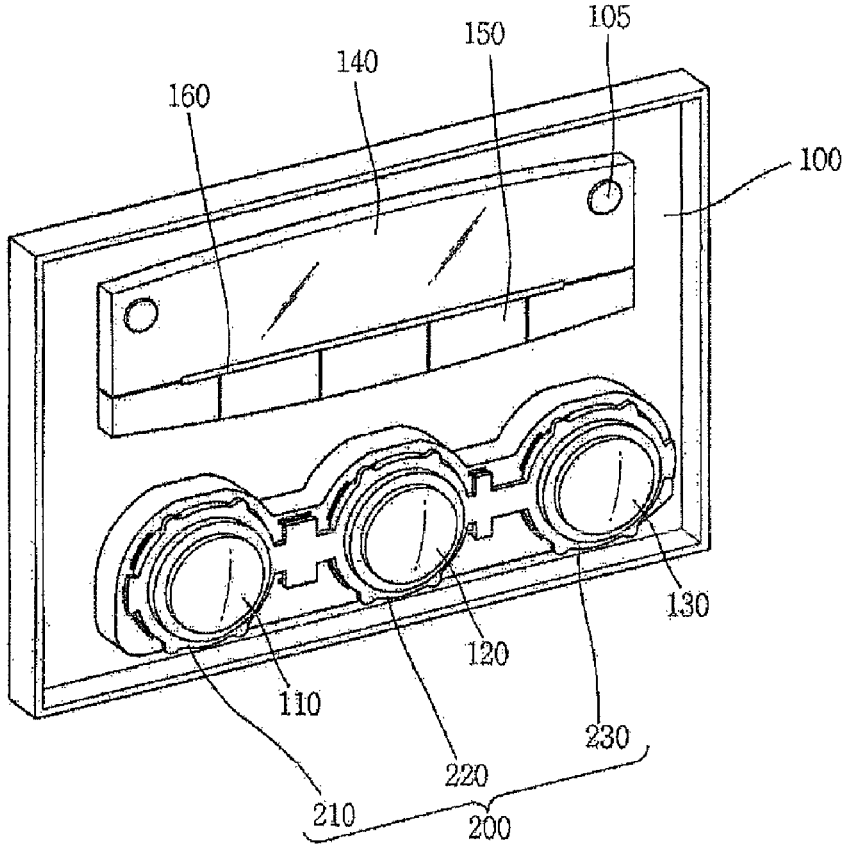
FIG. 1 is a front perspective view partially showing a control panel having an apparatus for coupling a display window and buttons for a clothing handler in accordance with a first embodiment of the present invention.
Figure 2:
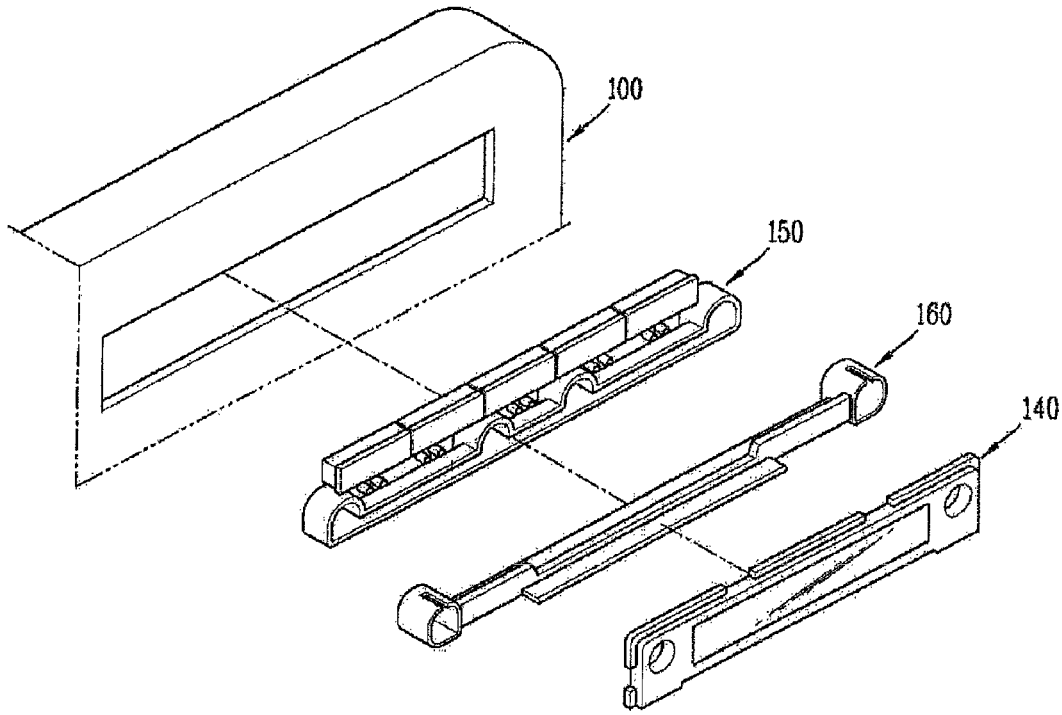
FIG. 2 is an exploded front perspective view showing the apparatus for coupling a display window and buttons for a clothing handler in accordance with the first embodiment of the present invention.

FIG. 1 is a front perspective view partially showing a control panel having an apparatus for coupling a display window and buttons for a clothing handler in accordance with a first embodiment of the present invention, and FIG. 2 is a disassembled view showing the display window and buttons for a clothing handler in accordance with the first embodiment of the present invention.

Referring to FIGS. 1 and 2 a control panel 100 of this embodiment includes circular buttons 110, 120, 130, a transparent window 200, a display window 140, rectangular buttons 150 and a supporting member 160.

The circular buttons 110, 120, 130 are selected to allow light emitting devices disposed at each peripheral portion of the circular buttons 110, 120, 130 to emit light according to the number of times the circular buttons 110, 120, 130 are respectively pressed and a corresponding function to be performed. The function corresponding to the number of times the circular buttons 110, 120, 130 are respectively pressed may be displayed through the display window 140.

The transparent window 200 is installed to encompass the circular buttons 110, 120, 130, thus covers a plurality of light emitting devices disposed at each peripheral portion of the circular buttons 110, 120, 130. In order to facilitate handling and fabricating thereof, the transparent window 200 is integrally formed and covers the plurality of light emitting devices at each periphery of the circular buttons 110, 120, 130.

A substrate unit (not shown) is installed at a rear side of the display window 140, and the substrate unit is provided with a display unit (not shown). The display unit is configured to display each kind of information regarding handling clothing, for example, applying of power, selection for a course, operating states, conditions, etc. so as to allow a user to recognize the information thereon.

The display window 140 covers the display unit so that the information displayed on the display unit can be viewed from the outside through the display window 140. And, the display window 140 serves to protect the display unit from an external impact, a foreign substance, etc.

The rectangular buttons 150 are configured to select options for handling clothing and are installed at a lower side of the display window 140 to be adjacent thereto. When the rectangular buttons 150 are disposed to be adjacent to the display window 140, it is capable of more effectively utilizing a space and implementing a compact clothing handler. However, there may be a drawback regarding a supporting force.

Therefore, in this embodiment, the supporting member 160 is interposed between the display window 140 and the rectangular buttons 150 with disposing the same to be adjacent to each other, thereby implementing effective space utilization and a compact configuration for the product and having a more enhanced supporting structure. Hereafter, it will be described in detail.

Figure 3:
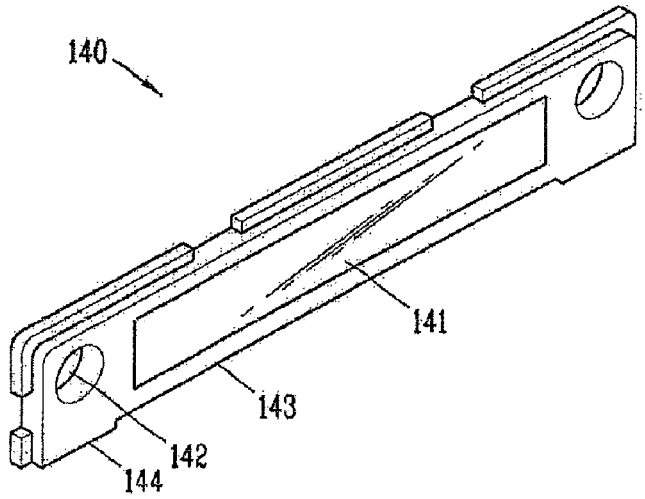
FIG. 3 is a front perspective view showing a display window in accordance with the first embodiment of the present invention.
Figure 4:
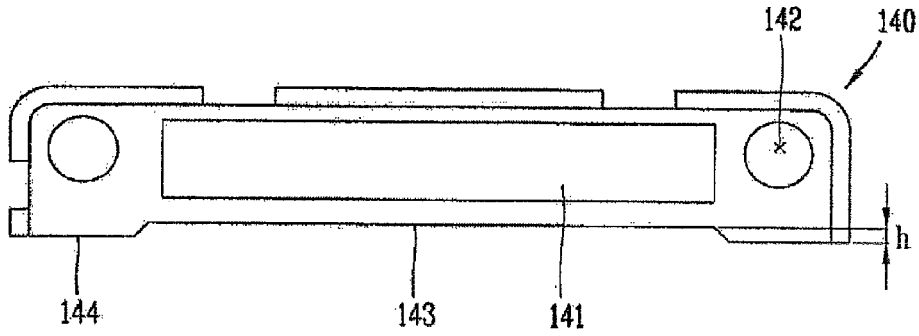
FIG. 4 is a front view showing the display window in accordance with the first embodiment of the present invention.

FIG. 3 is a front perspective view showing a display window in accordance with the first embodiment of the present invention, and FIG. 4 is a front view showing the display window in accordance with the first embodiment of the present invention.

Referring to FIGS. 3 and 4, the display window 140 of this embodiment is provided with a window main body 141. And, the window main body 141 is provided with a small circular button hole 142, a lower end portion 144 and a spaced portion 143.

The lower end portion 144 of the window main body 141 is adjacent to the rectangular buttons 150.

The spaced portion 143 is configured to be upwardly spaced from the lower end portion 144 by a specific height (h). The spaced portion 143 comes in contact with the supporting member 160.

With the configuration of the spaced portion 143, a step height is generated between the spaced portion 143 and the lower end portion 144 due to a difference in the height (h) between the spaced portion 143 and the lower end portion 144. And, the supporting member 160 is partially locked to the stepped portion, accordingly the display window 140 may be supported by the supporting member 160.

Figure 5:
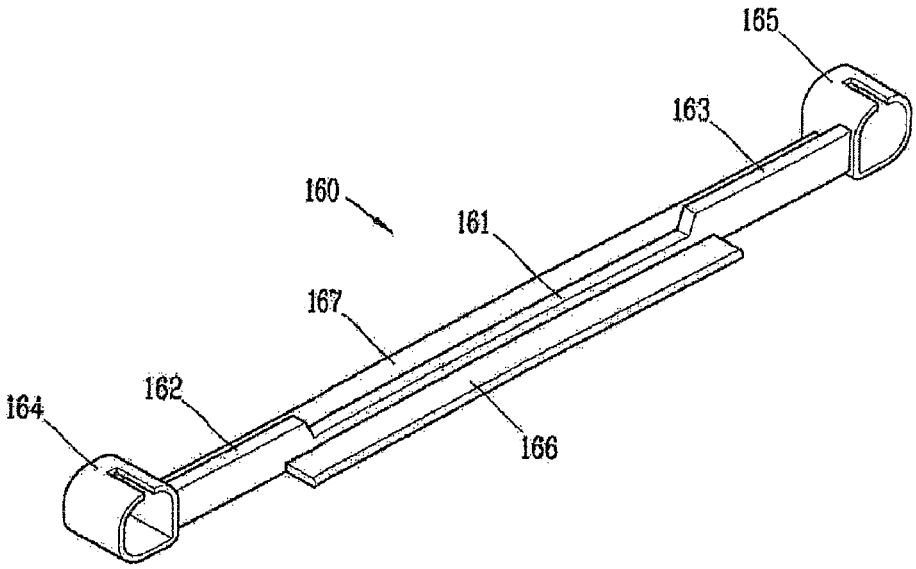
FIG. 5 is a front perspective view showing a supporting member in accordance with the first embodiment of the present invention.
Figure 6:
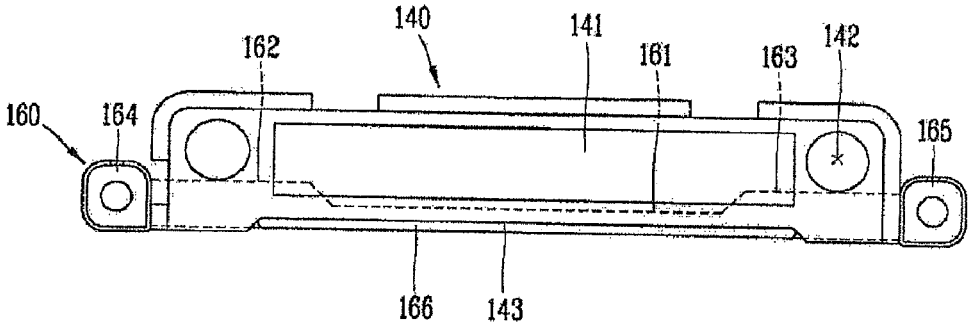
FIG. 6 is a front view showing that the display window is coupled to the supporting member in accordance with the first embodiment of the present invention.

FIG. 5 is a front perspective view showing a supporting member in accordance with the first embodiment of the present invention, and FIG. 6 is a front view showing that the supporting member is coupled to the display window in accordance with the first embodiment of the present invention.

Referring to FIGS. 5 and 6, the supporting member 160 of this embodiment includes a rear supporting portion 161, reinforcing portions 162, 163, coupling portions 164, 165, and a lower supporting portion 166. The supporting member 160 is interposed between the display window 140 and the rectangular buttons 150 so as to support at least one of the display window 140 and the rectangular buttons 150.

The coupling portions 164, 165 are formed at both end portions of the supporting member 160 and respectively coupled to a coupling member such as a screw. Accordingly, the supporting member 160 is coupled to the control panel 100.

The rear supporting portion 161 serves to connect the coupling portions 164, 165 to each other and support the display window 140 in a horizontal direction. The rear supporting portion 161 is extended toward a rear surface of the display window 140, thus supports the display window 140 at the rear side of the display window 140.

The reinforcing portions 162, 163 are connected to each coupling portion 164, 165, and the rear supporting portion 161 so as to support the display window 140. That is, the reinforcing portions 162, 163 are further protruded upwardly from the rear supporting portion 161 and have rear surfaces coupled to the coupling portions 164, 165, respectively. Accordingly, the reinforcing portions 162, 163 support the display window 140 from the rear side with reinforcement.

The lower supporting portion 166 is extended between the display window 140 and the rectangular buttons 150 so as to support the display window 140. That is, an upper surface of the lower supporting portion 166 is disposed to be adjacent to the spaced portion 143 of the display window 140 and a lower surface thereof is disposed to be adjacent to the upper surface of the rectangular buttons 150 so as to support the display window 140.

As such, the rear supporting portion 161, the reinforcing portions 163, 164 and the lower supporting portion 166 coupled to the control panel 100 through the coupling portions 164, 165 may serve to firmly support the display window 140. Therefore, by disposing the display window 140 and the rectangular buttons 150 to be adjacent to each other and interposing the supporting member 160 therebetween, it is capable of implementing effective space utilization and the compact configuration for the product and having a more enhanced supporting structure.

The lower supporting portion 166 may be outwardly exposed between the display window 140 and the rectangular buttons 150. The supporting member 160 including the lower supporting portion 166 may be plated with chrome. Since the lower supporting portion 166 plated with chrome is outwardly exposed, it is capable of implementing an excellent appearance.

Hereafter, a second embodiment of the present invention will be described. Some description same as that of the first embodiment will be omitted.

Figure 7:
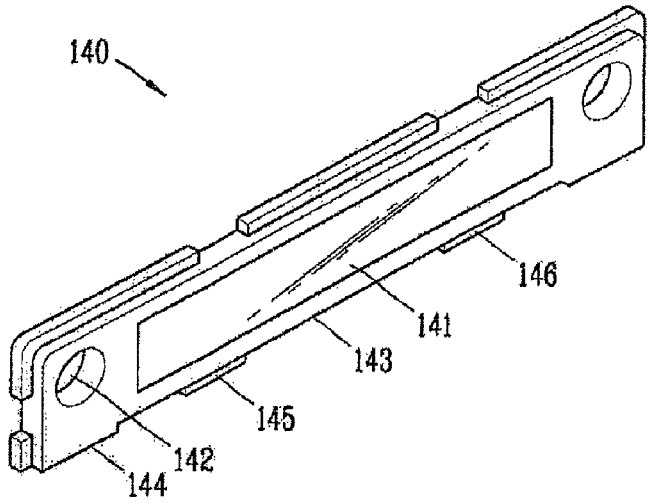
FIG. 7 is a front perspective view showing a display window in accordance with a second embodiment of the present invention.
Figure 8:
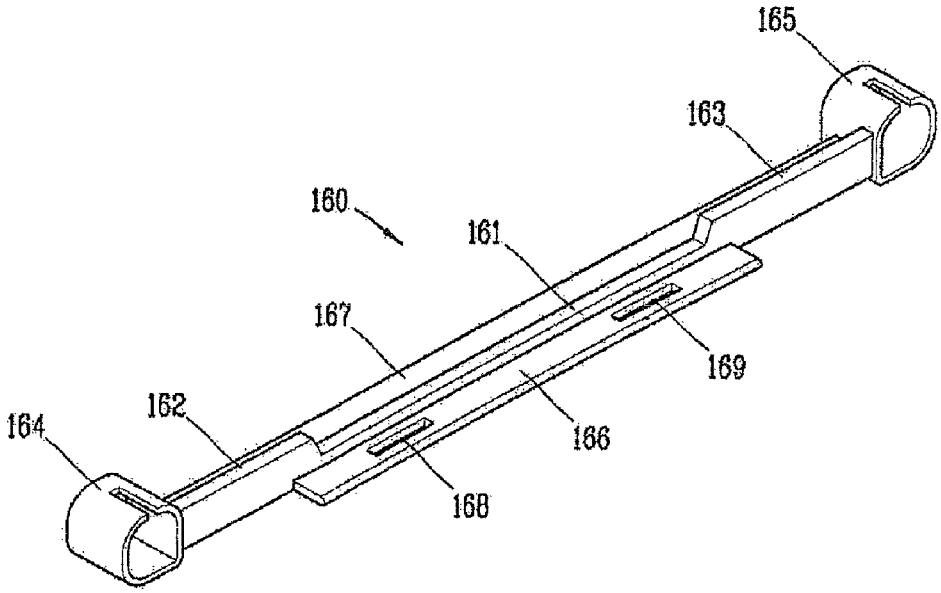
FIG. 8 is a front perspective view showing a supporting member in accordance with the second embodiment of the present invention.

FIG. 7 is a front perspective view showing a display window in accordance with a second embodiment of the present invention, and FIG. 8 is a front perspective view showing a supporting member in accordance with the second embodiment of the present invention.

Referring to FIGS. 7 and 8, in this embodiment, the spaced portion 143 of the display window 140 is provided with coupling protrusions 145, 146. And, coupling holes 168, 169 into which the coupling protrusions 145, 146 are inserted to be engaged are formed at the lower supporting portion 166 of the supporting member 160 adjacent to the display window 140.

When the display window 140 and the supporting member 160 are disposed to be adjacent to each other, the coupling protrusions 145, 146 are coupled to the coupling holes 168, 169. Accordingly, it is capable of coupling the display window 140 to the supporting member 160 more firmly. Therefore, the display window 140 can be supported by the supporting member 160 more firmly.

Here, it is disclosed that the coupling protrusions 145, 146 and the coupling holes 168, 169 are formed at the spaced portion 143 and the lower supporting portion 166, however, this is merely exemplary. Concavo-convex portions that can be engaged with each other may be formed at the display window 140 and a part of the supporting member 160 so as to obtain the supporting force same as the aforementioned.

In the apparatus for coupling the display window and the buttons for the clothing handler in accordance with one aspect of the present invention, the display window and the buttons are disposed to be adjacent to each other, and the supporting member is interposed therebetween. Accordingly, it is capable of implementing effective space utilization and the compact configuration for the product and having the more enhanced supporting structure.

Further, in the apparatus for coupling the display window and the buttons for the clothing handler, concavo-convex portions that can be engaged with each other are formed at the display window and the supporting member. Accordingly, it is capable of coupling the display window to the supporting member more firmly. Therefore, the display window may be supported by the supporting member more firmly.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A coupling apparatus for a washing machine or dryer, comprising:

a display window configured to display information regarding handling clothing;

one or more buttons, disposed to be adjacent to the display window, for selecting options for handling clothing; and a supporting member, interposed between the display window and the one or more buttons, wherein the display window and one or more buttons are aligned along a vertical axis with the supporting member disposed therebetween and wherein the supporting member has a width along a horizontal axis substantially equal to or greater than a width of at least one of the buttons and substantially equal to or less than a width of the display window.

2. The apparatus of claim 1, wherein the supporting member is provided with a lower supporting portion extended between the display window and the one or more buttons so as to support the display window.

3. The apparatus of claim 2, wherein the lower supporting portion is outwardly exposed between the display window and the buttons.

4. The apparatus of claim 1, wherein the supporting member is provided with a rear supporting portion extended toward a rear surface of the display window so as to support the display window.

5. The apparatus of claim 4, wherein the supporting member is provided with at least one coupling portion to couple the supporting member to a main body of the washing machine or dryer.

6. The apparatus of claim 5, wherein the supporting member includes at least two coupling portions to couple the supporting member to the main body of the washing machine or dryer, and wherein the rear supporting portion connects the at least two coupling portions to each other and supports the display window.

7. The apparatus of claim 5, wherein one or more reinforcing portions are formed to support the display window and are coupled to the at least one coupling portion and the rear supporting portion.

8. The apparatus of claim 4, wherein the supporting member is provided with a lower supporting portion extended between the display window and the one or more buttons so as to support the display window.

9. The apparatus of claim 1, wherein the supporting member is plated with chrome.

10. The apparatus of claim 1, wherein the display window includes one or more coupling protrusions and the supporting member includes one or more coupling holes to receive respective ones of the one or more coupling protrusions.

11. The apparatus of claim 1, wherein the supporting member includes:

a first member between the display window and the one or more buttons; and a second member located between ends of the supporting member and projecting from the first member in a first direction, wherein the first member is not visible from a position in front of the display window and wherein the second member is visible from said position in front of the display window.

12. The apparatus of claim 11, wherein the first member supports at least one of the display window or the one or more buttons.

13. The apparatus of claim 11, wherein the second member projects a distance from the first member to allow at least a front surface of the second member to be visible from said position in front of the display window.

14. The apparatus of claim 13, wherein the second member projects a distance from the first member to allow the front surface of the second member to either be even with a front surface of one or more of the display window or the one or more buttons or to project beyond the front surface of the one or more of the display window or the one or more buttons in the first direction.

15. The apparatus of claim 14, wherein the first direction is at least substantially perpendicular to the front surface of one or more of the display window or the one or more buttons.

16. The apparatus of claim 15, wherein the second member includes at least one coupling structure that mates with a complementary coupling structure projecting from the display window or the one or more buttons.

17. The apparatus of claim 16, wherein the at least one coupling structure of the second member is a recess and the complementary coupling structure of the display window is a projection that mates with the recess.

18. The apparatus of claim 13, wherein the display window is incorporated within a casing that has a surface containing a recess having a size that corresponds to a width of the second member projecting from the first member, and wherein the second member projecting from the first member is located between the surface of the display window casing containing the recess and a surface of the one or more buttons.

19. The apparatus of claim 11, further comprising:

a first reinforcing member disposed between one end of the supporting member and the second member; and a second reinforcing member disposed between the other end of the supporting member and the second member.

20. The apparatus of claim 19, wherein the first and second reinforcing members have first heights in a direction substantially perpendicular to said first direction and wherein the second member has a second height in said direction substantially perpendicular to said first direction, said first heights being greater than said second height.

21. The apparatus of claim 20, wherein the first and second reinforcing members have substantially same first heights.

22. The apparatus of claim 1, wherein the display window is located above the one or more buttons and wherein the supporting member supports the display window.

23. The apparatus of claim 1, wherein the width of the display window is at least substantially co-extensive with a combined width of all the one or more buttons.

24. The apparatus of claim 23, wherein the width of the supporting member is less than a width of the display window.

25. The apparatus of claim 24, wherein the one or more buttons are below the display window.

26. The apparatus of claim 24, wherein the display window and the one or more buttons are exposed along a surface of a control panel of the washing machine or dryer, and wherein the one or more buttons and the display window are adjacent to one another such that no portion of the surface of the control panel is visible in a space between the one or more buttons and the display window.

27. The apparatus of claim 26, wherein the display window and the one or more buttons are arranged in a shape that has a substantially rectangular perimeter.

28. A laundry machine comprising:

a control panel that includes:

a display window configured to display clothes handing information;

one or more buttons, adjacent to the display window, to select options for handling clothing; and a supporting member located between the display window and the one or more buttons, wherein the display window and the one or more buttons are aligned along a vertical axis with the supporting member disposed therebetween and wherein the supporting member has a width along a horizontal axis substantially equal to or greater than a width of at least one of the buttons and substantially equal to or less than a width of the display window.

29. The laundry machine of claim 28, wherein the supporting member includes:

a first member between the display window and the one or more buttons; and a second member located between ends of the supporting member and projecting from the first member in a first direction, wherein the first member is not visible from a position in front of the display window and wherein the second member is visible from said position in front of the display window.

30. The laundry machine of claim 29, wherein the second member projects a distance from the first member to allow at least a front surface of the second member to be visible from said position in front of the display window.

31. The laundry machine of claim 30, wherein the second member projects a distance from the first member to allow the front surface of the second member to either be even with a front surface of one or more of the display window or the one or more buttons or to project beyond the front surface of the one or more of the display window or the one or more buttons in the first direction.

32. The laundry machine of claim 31, wherein the first direction is at least substantially perpendicular to a front surface of one or more of the display window or the one or more buttons.

* * * * *